US008376162B2

(12) United States Patent
Yang

(10) Patent No.: US 8,376,162 B2
(45) Date of Patent: Feb. 19, 2013

(54) WATER JAR LID STRUCTURE WHICH OPENS A WATER PASSAGE TO ALLOW EASY CONSUMPTION OF WATER WHEN SUBJECTED TO DEPRESSION

(75) Inventor: Shih-Sheng Yang, Taipei Hsien (TW)

(73) Assignee: Universal Trim Supply Co., Ltd., Taipei Hsien (TW)

( * ) Notice: Subject to any disclaimer, the term of this patent is extended or adjusted under 35 U.S.C. 154(b) by 660 days.

(21) Appl. No.: 12/479,874

(22) Filed: Jun. 8, 2009

(65) Prior Publication Data

US 2010/0282703 A1 Nov. 11, 2010

(30) Foreign Application Priority Data

May 5, 2009 (TW) ..... 98114913 A

(51) Int. Cl.

| | |
|---|---|
| ***B65D 41/00*** | (2006.01) |
| ***B65D 51/04*** | (2006.01) |
| ***B65D 25/08*** | (2006.01) |
| ***B65D 83/00*** | (2006.01) |
| ***B65D 23/10*** | (2006.01) |
| ***A47G 19/22*** | (2006.01) |
| ***A45F 5/00*** | (2006.01) |

(52) U.S. Cl. ..... 215/244; 215/387; 215/396; 215/399; 220/717; 220/715; 220/212.5; 220/254.3; 220/254.5; 220/264; 222/470; 222/472; 224/269

(58) Field of Classification Search ..... 220/264, 220/751, 756, 768, 830, 715, 714, 254.6, 220/254.5, 254.3, 716, 212.5; 222/472–474, 222/509, 512, 518, 498, 470; 215/244, 387, 215/396, 399; 224/269

See application file for complete search history.

(56) References Cited

U.S. PATENT DOCUMENTS

| | | | | |
|---|---|---|---|---|
| 3,739,938 | A * | 6/1973 | Paz | 220/715 |
| 5,477,980 | A * | 12/1995 | Chaffin | 220/715 |
| 5,944,235 | A * | 8/1999 | Won | 222/506 |
| 6,427,880 | B1 * | 8/2002 | Hirose et al. | 222/517 |
| 8,297,462 | B1 * | 10/2012 | Joyce | 220/254.5 |

* cited by examiner

*Primary Examiner* — Robin Hylton
(74) *Attorney, Agent, or Firm* — Leong C. Lei

(57) ABSTRACT

A water stop structure is mounted to a water jar. A main body includes a depression bar device, a resiliency device, and a water stop member. The depression bar device includes a movable depression bar that is releasably connectable to a hanger formed on the main body. The resiliency device includes a rod that maintains the depression bar in position with a first resilient element. A second resilient element maintains the rod in position to have the water stop member blocking a water passage of the main body. When the depression bar is depressed to travel through a first stroke, the depression bar disengages from the hanger to form an opening therebetween for easy hanging and use of the water jar. When the depression bar travels through a second stroke, the rod drives the water stop member away from the water passage to allow a user to drink water.

5 Claims, 8 Drawing Sheets

WATER JAR LID STRUCTURE WHICH OPENS A WATER PASSAGE TO ALLOW EASY CONSUMPTION OF WATER WHEN SUBJECTED TO DEPRESSION

(a) TECHNICAL FIELD OF THE INVENTION

The present invention generally relates to a lid of a water jar, and particularly to a water stop structure of a water jar lid, which, when depressed to travel through a first stroke, opens a hanger to form an opening for hanging and use, and when traveling through a second stroke, opens a water passage for dispensing water from the jar for consuming.

(b) DESCRIPTION OF THE PRIOR ART

Human beings must consume a certain amount of water everyday to maintain sufficient water inside their bodies. A water jar or flask is commonly used to contain and carry water or liquid beverages for convenient and immediate access and replenishment of water and this is particularly good for people doing outdoor activities, such as hiking, mountain climbing, skiing, and bike riding.

The water jars or containers for liquid available in the market are often provided with a lid the control discharge and block of water. Besides the basic feature of providing a space for containing and carrying water, a water jar is also assessed for the following two aspects:

(1) How to effectively control discharge and stop of water to allow a user to conveniently and efficiently drink water.

(2) How to simplify hand carry the jaw in order to realize easy carrying of the jar by hanging the jar to for example a backpack, a bicycle, a belt, or a tree branch.

The water jars that are currently available in the market do not meet the needs of the general consumers in these two aspects, and the present invention aims to provide a water jar lid structure that offers both practicability and convenience.

SUMMARY OF THE INVENTION

A primary objective of the present invention is to provide a water jar lid structure, which when subjected to depression in a predetermined stroke opens a water passage to allow easy consumption of water contained therein.

Another objective of the present invention is to provide a water jar lid structure, which can be easily hung and used when depressed in a predetermined stroke.

To achieve the above objectives, the present invention provides a structure that comprises main body for mounting to a water jar. The main body forms a water passage, a chamber, and a hanger. A depression bar device comprises a depression bar that is connected to the main body in a movable manner. A resiliency device comprises a rod, a first resilient element, and a second resilient element. The rod is movably received and extends through the chamber of the main body. The first resilient element is set between the depression bar and the rod to maintain the depression bar in a predetermined position. The second resilient element is set between the chamber and the rod to maintain the rod in a predetermined position. A water stop member is coupled to the rod and has one side portion fixed to an underside of the main body. The water stop member comprises a water sealing section that blocks the water passage. When the depression bar is depressed to travel through a first stroke, only the first resilient element is compressed and the water stop member maintains blocking the water passage. When the depression bar is depressed to travel through a second stroke, the rod is caused to have the water stop member separating from the water passage to allow consumption of the water contained in the water jar.

The foregoing objective and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
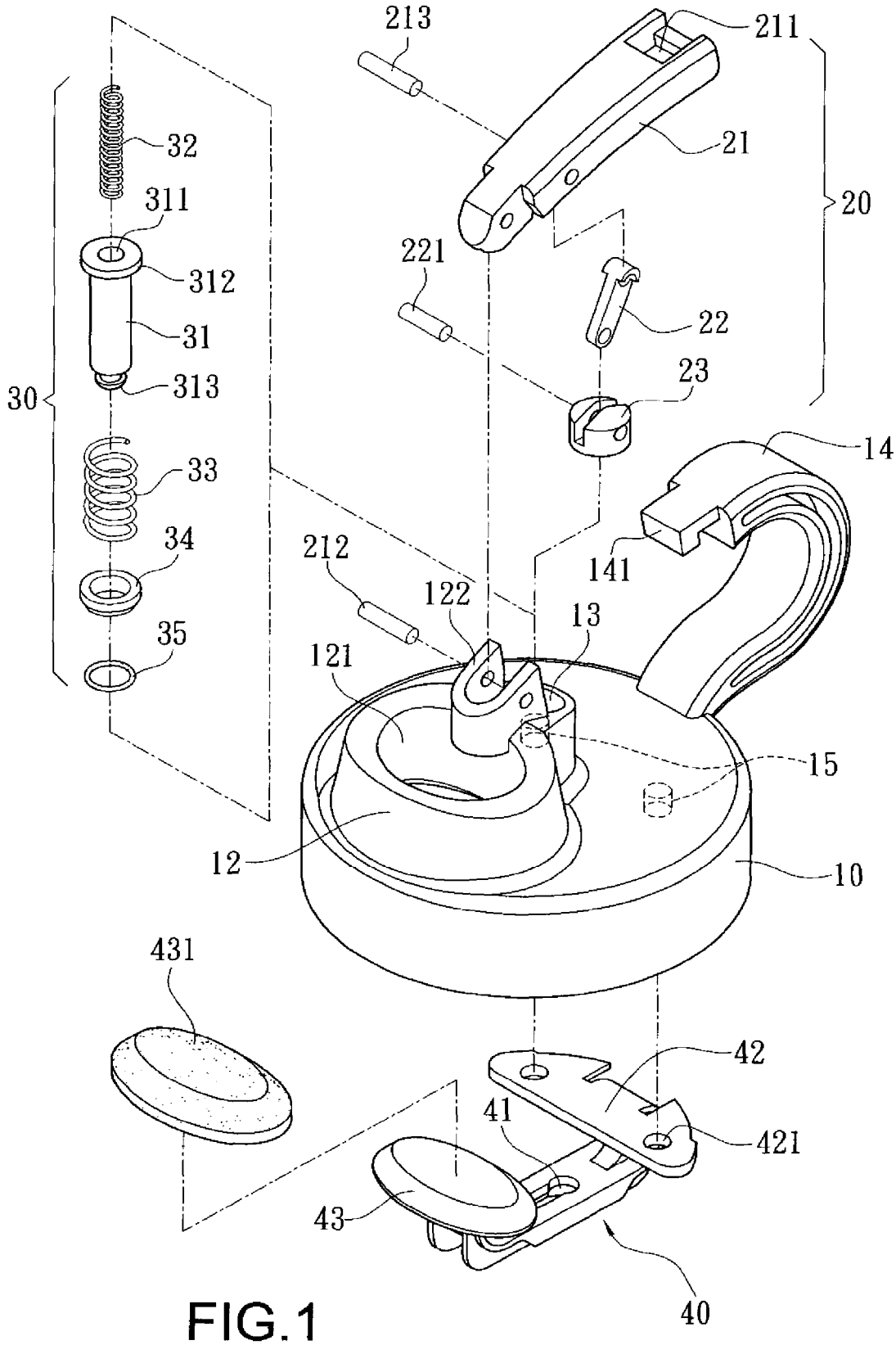
FIG. 1 is an exploded view of the present invention.
Figure 2:
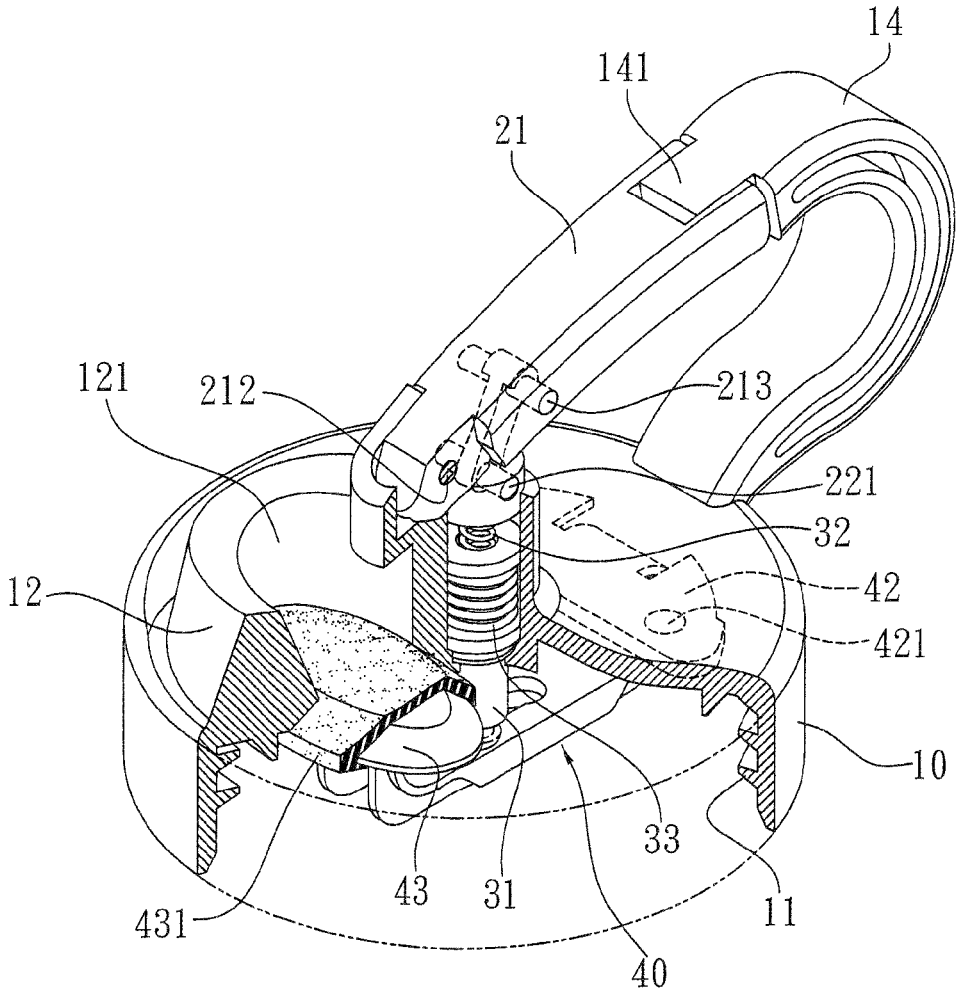
FIG. 2 is a perspective view, partially broken, of the present invention.
Figure 3:
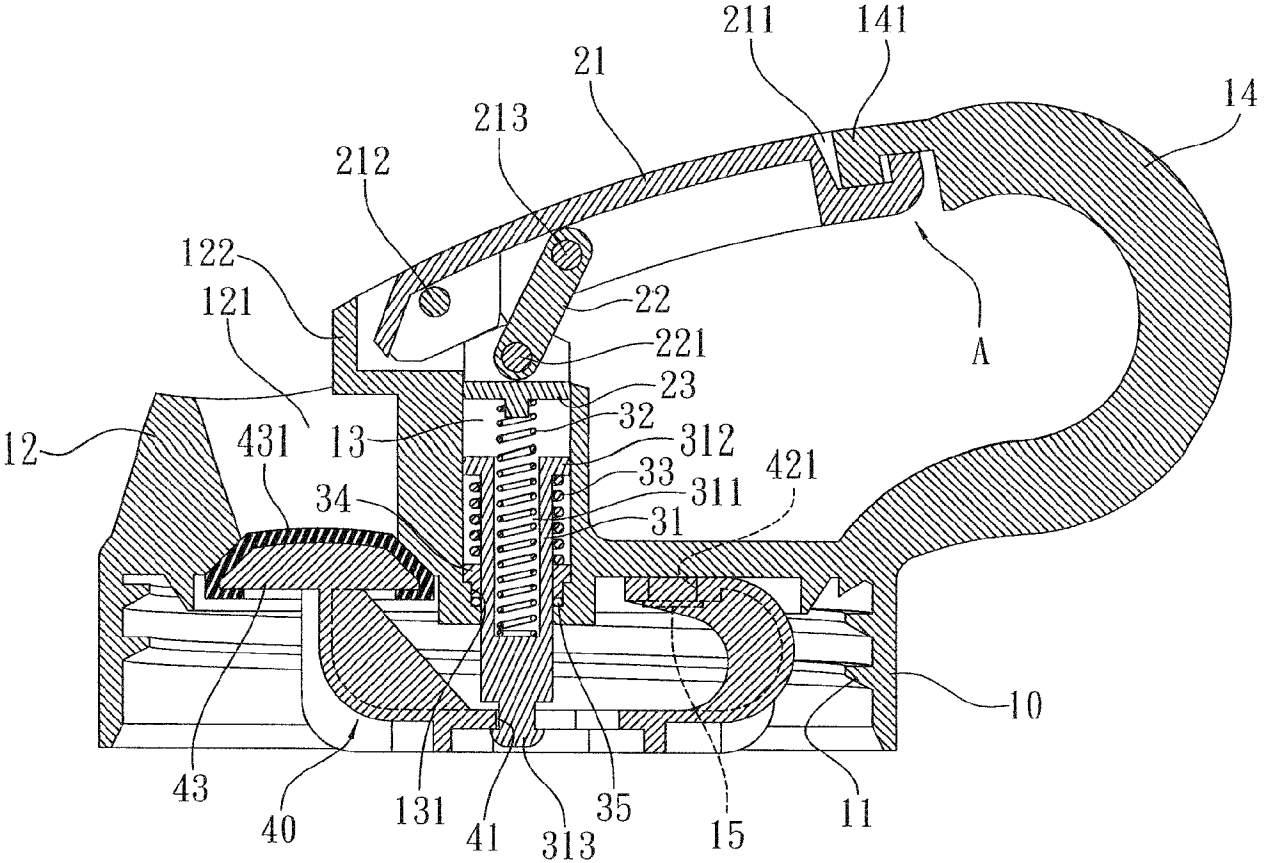
FIG. 3 is a cross-sectional view of the present invention in an assembled form.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1-4, structurally, the present invention comprises a main body 10, a depression bar device 20 for hand depression, a resiliency device 30 for controlling discharge and stop of water, a water stop member 40 driven by the resiliency device 30. In use, the depression bar device 20 is depressed to drive the resiliency device 30 to take a two-stage operation, whereby the water stop member 40 allows water to be discharged only when the depression bar device 20 is depressed to move through a deep stroke.

The main body 10 forms an internal thread 11 (see FIGS. 2 and 3) and is coupled to a water jar 90 (see FIG. 4) through the internal thread 11. The main body 10 forms a water outlet port 12 that defines a water passage 121. Water contained inside the water jar 90 can be poured out through the water passage 121. The water outlet port 12 forms a U-shaped flange 122 for coupling with the depression bar device 20. The main body 10 forms a chamber 13 inside which a step 131 (see FIG. 3) is formed. The chamber 13 receives the resiliency device 30 therein. The main body 10 has a top that forms, at one edge thereof, a fixed hanger 14. The hanger 14 has an open free end forming a hook 141, which is connectable with the depression bar device 20. The main body 10 has an underside surface forming a plurality of coupling pegs 15, which is coupled to the water stop member 40.

The depression bar device 20 comprises a depression bar 21, which has an end forming a fitting slot 211 engageable with the hook 141, so as to establish a releasable connection between the depression bar 21 and the hanger 14. An opposite end of the depression bar 21 receives a pivot 212 extending therethrough for movable connection with the flange 122 of the main body 10. A lower portion of the depression bar 21 also receives a pivot 213 extending therethrough for movable connection with a link 22. The link 22 has a lower portion that receives a pivot 221 extending therethrough for movable connection with a carrier 23 movably received in the chamber 13, whereby when the depression bar 21 is depressed downward, the link 22 is caused to drive the carrier 23 downward (see FIG. 3).

The resiliency device 30 comprises a rod 31, a first resilient element 32, which serves as a compression spring, a second resilient element 33, which serves as a compression spring, a ring spacer 34, and a ring seal 35. The rod 31 is arranged to have a portion thereof received in the chamber 13, and another portion of the rod 31 projects under the main body 10. The rod 31 forms a bore 311 in a center thereof to receive and retain the first resilient element 32 therein in such a way that a top end of the first resilient element 32 projects outside to couple to the carrier 23. The first resilient element 32 supports the depression bar 21 so as to maintain the depression bar 21 at a predetermined position where, before being depressed, the depression bar 21 is held with a free end A thereof engaging the hanger 14 to form a close-loop configuration (see FIG. 3). The rod 31 forms a radial flange 312 at a top end thereof and a rounded jointing end 313 at a bottom end thereof. The flange 312 is set in contact with an inside wall of the chamber 13 to maintain a gap between the rod 31 and the inside wall of the chamber 13 for receiving the second resilient element 33 that is arranged inside the chamber 13 but fit outside the rod 31. The step 131 of the chamber 13 supports the spacer 34 and the seal 35 in such a way that upper and lower ends of the second resilient element 33 are respectively supported on the flange 312 of the rod 31 and the spacer 34, whereby the second resilient element 33 maintains the rod 31 in a predetermined position. The seal 35 provides sealing at an interface where the rod 31 extends through the main body 10 to ensure water tightness and prevent leaking of water. The arrangement of the spacer 34 prevents direct engagement of the second resilient element 33 with the seal 35 and thus protects the functionality of the seal 35 and extends the lifespan thereof. The first resilient element 32 and the second resilient element 33 are both not set in contact with water or other liquids contained in the water jar 90 (see FIG. 4), whereby users can be protected from taking metal corrosion or oil contaminants when they drink water. The second resilient element 33 provides a spring force greater than that of the first resilient element 32, whereby when the depression bar 21 is depressed in a first stage or stroke of depression, only the first resilient element 32 is caused to undergo compression, but the rod 31 is not moved downward. Thus, the first stroke only opens the depression bar 21 (see FIG. 4). Further and deeper depression of the depression bar 21 causes movement through a second stage or stroke, where the second resilient element 33 is compressed and the rod 31 is moved to remove the water stop member 40 for opening the water passage.

The water stop member 40 is of a substantially U-shape and forms a fitting hole 41 at a central portion thereof. The lower, jointing end 313 of the rod 31 is fit into and thus coupled to the fitting hole 41 so as to couple the water stop member 40 and the rod 31 together. The water stop member 40 forms on one limb a mount board 42, which defines a plurality of coupling holes 421 corresponding to and engaging the coupling pegs 15 on the underside of the main body to secure them together. The water stop member 40, with one limb coupled to the main body 10, has another limb forming a water sealing section 43, to which a food grade and temperature resistant silicone rubber pad 431 is mounted, whereby the silicone rubber pad 431 is set in tight engagement with the water passage 121 to stop water and prevent leaking of water.

Figure 4:
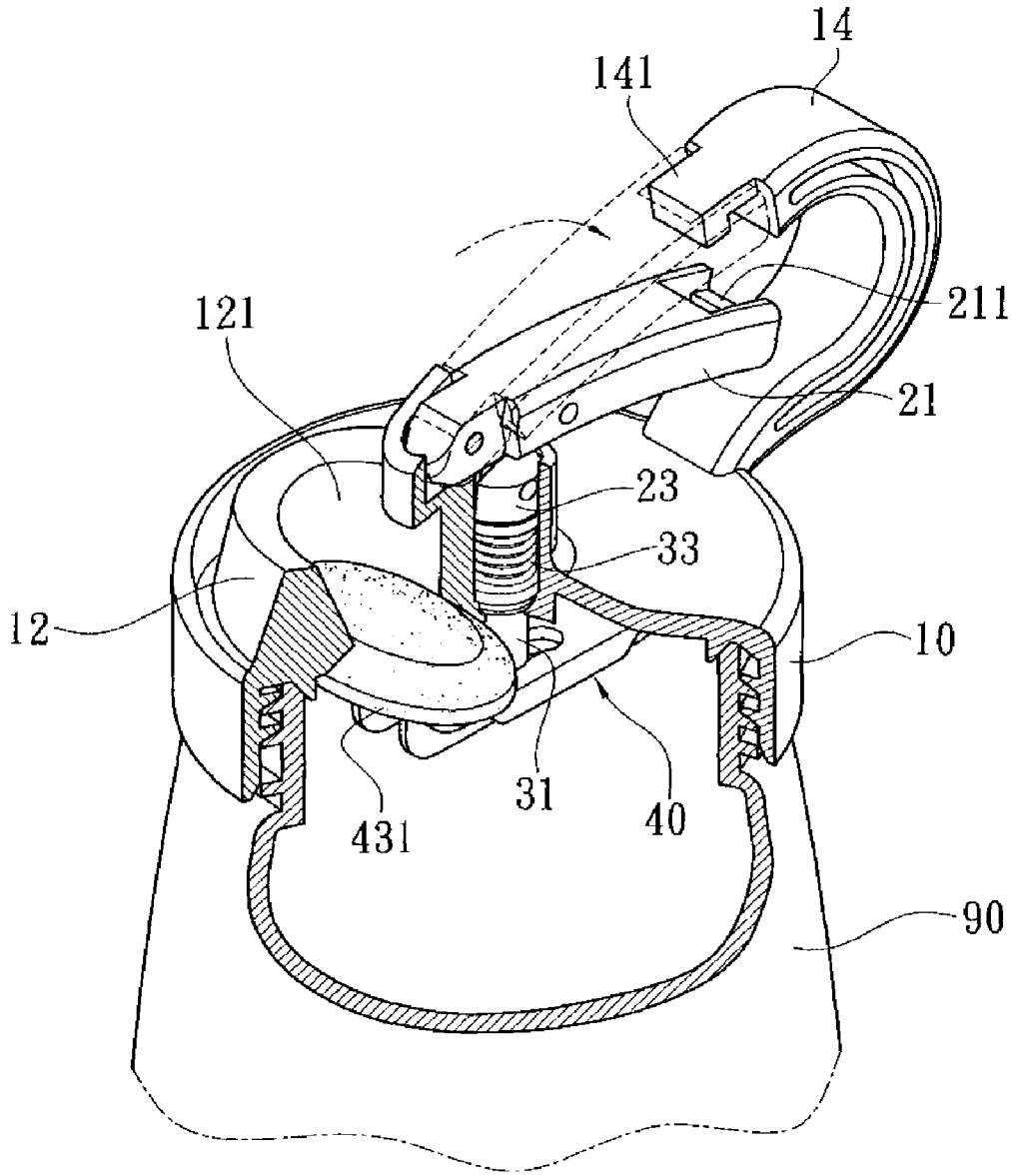
FIG. 4 is a schematic perspective view illustrating a depression bar of the present invention undergoing a first stroke.
Figure 5:
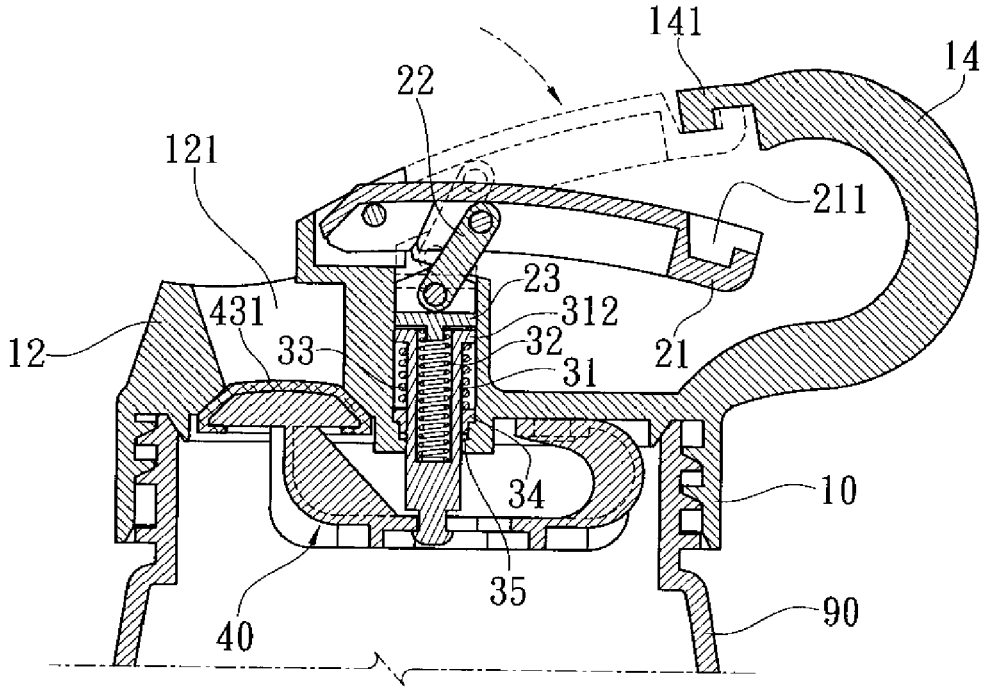
FIG. 5 is a cross-sectional view of FIG. 4.
Figure 6:
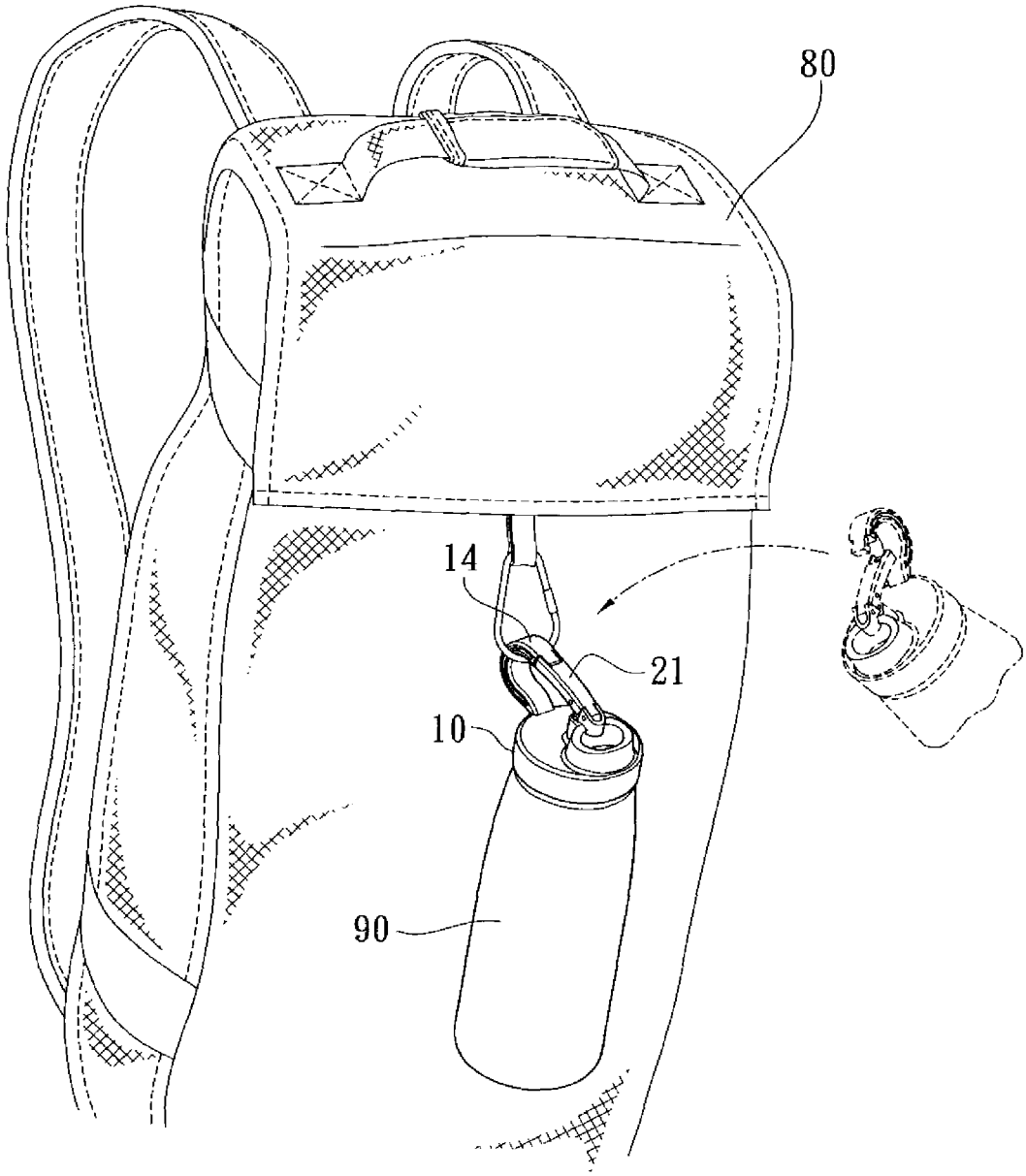
FIG. 6 is a perspective view illustrating the present invention hung on a backpack.

Referring to FIGS. 4 and 5, to use the present invention, when the depression bar 21 is depressed to travel through the first stroke, the fitting slot 211 of the depression bar 21 is caused to move away from the connection with the hanger 14, whereby the close-loop configuration formed by the depression bar 21 and the hanger 14 is broken into an open configuration that sets a wide opening through which a user may hang the water jar 90 on a backpack 80 (see FIG. 6), a bicycle, or a tree branch. In a preferred embodiment of the present invention, this opening allows a user to hang the water jar 90 on any rigid article having an outside diameter less than 10 mm. Similarly, the user may readily remove the water jar 90 from where the water jar 90 is hanged. At this time, the first resilient element 32 is compressed by the link 22 that is driven by the depression of the depression bar 21 and potential energy is built up for providing a returning spring force, and also, the rod 31 and the second resilient element 33 are not moved and compressed, maintaining the water stop member 40 in the water sealing condition to ensure no water leaking through the water passage 121 of the main body 10 will occur. If the user does not further depress the depression bar 21 and instead releases the depression bar 21, due to the removal of the depression force, the depression bar 21 is returned to the original position by the spring force of the first resilient element 32 to resume the close-loop configuration where the depression bar 21 engages the hanger 14, so as to prevent the water jar 90 from falling off the location where it is hanged.

Figure 8:
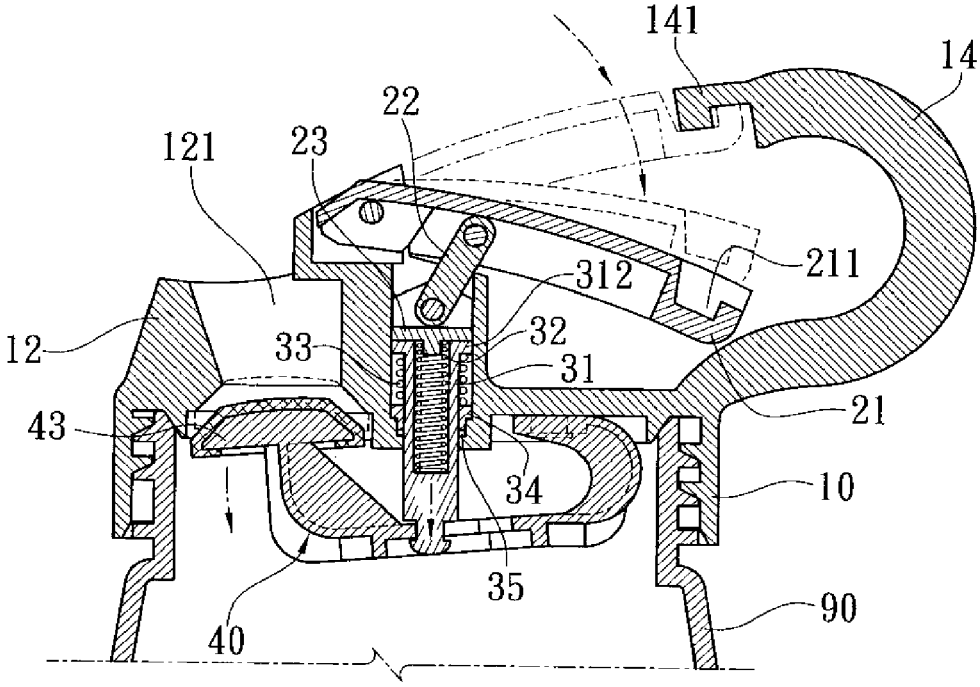
FIG. 8 is a cross-sectional view of FIG. 7.
Figure 7:
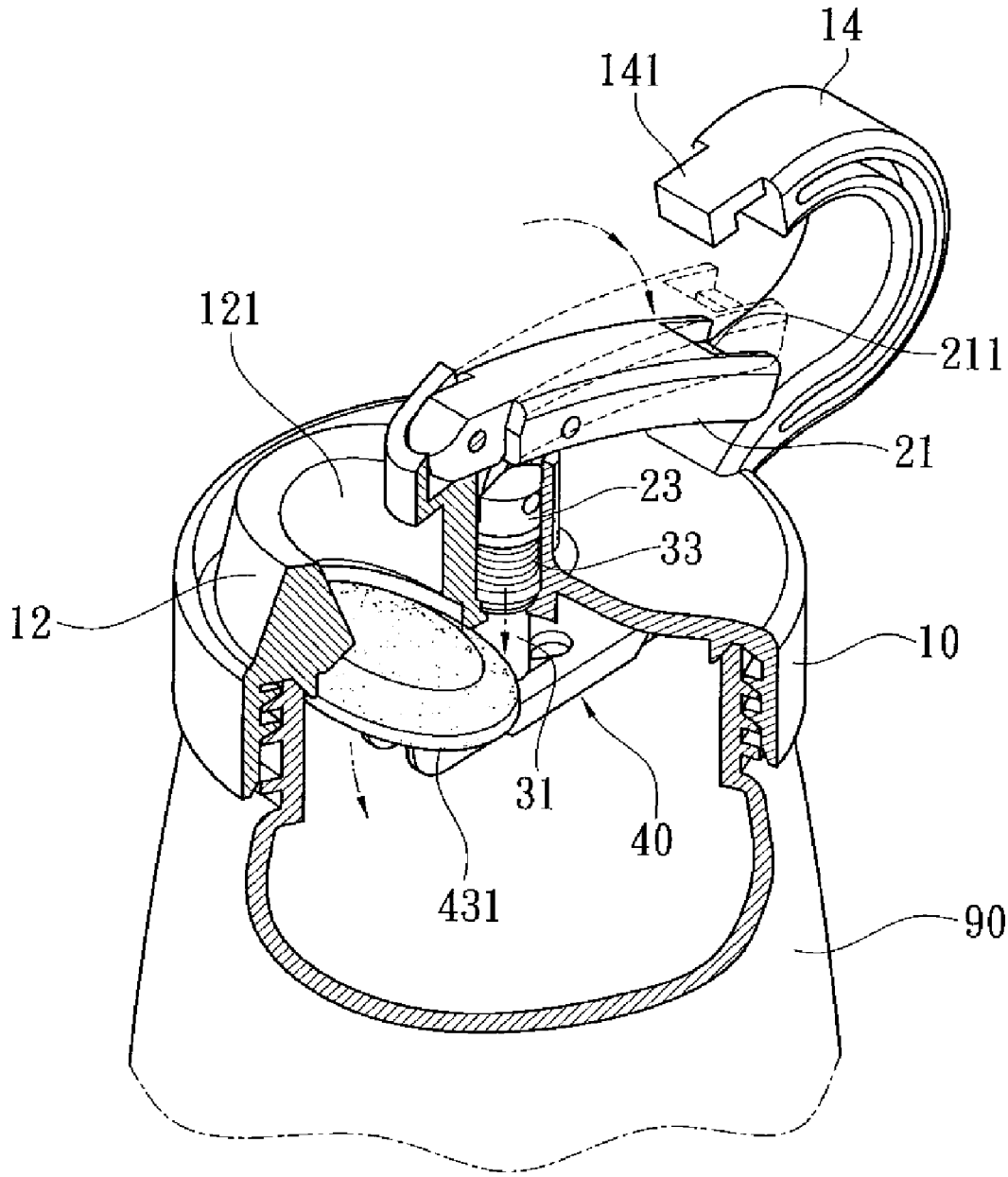
FIG. 7 is a schematic perspective view illustrating a depression bar of the present invention being further depressed to undergo a second stroke.
Figure 9:
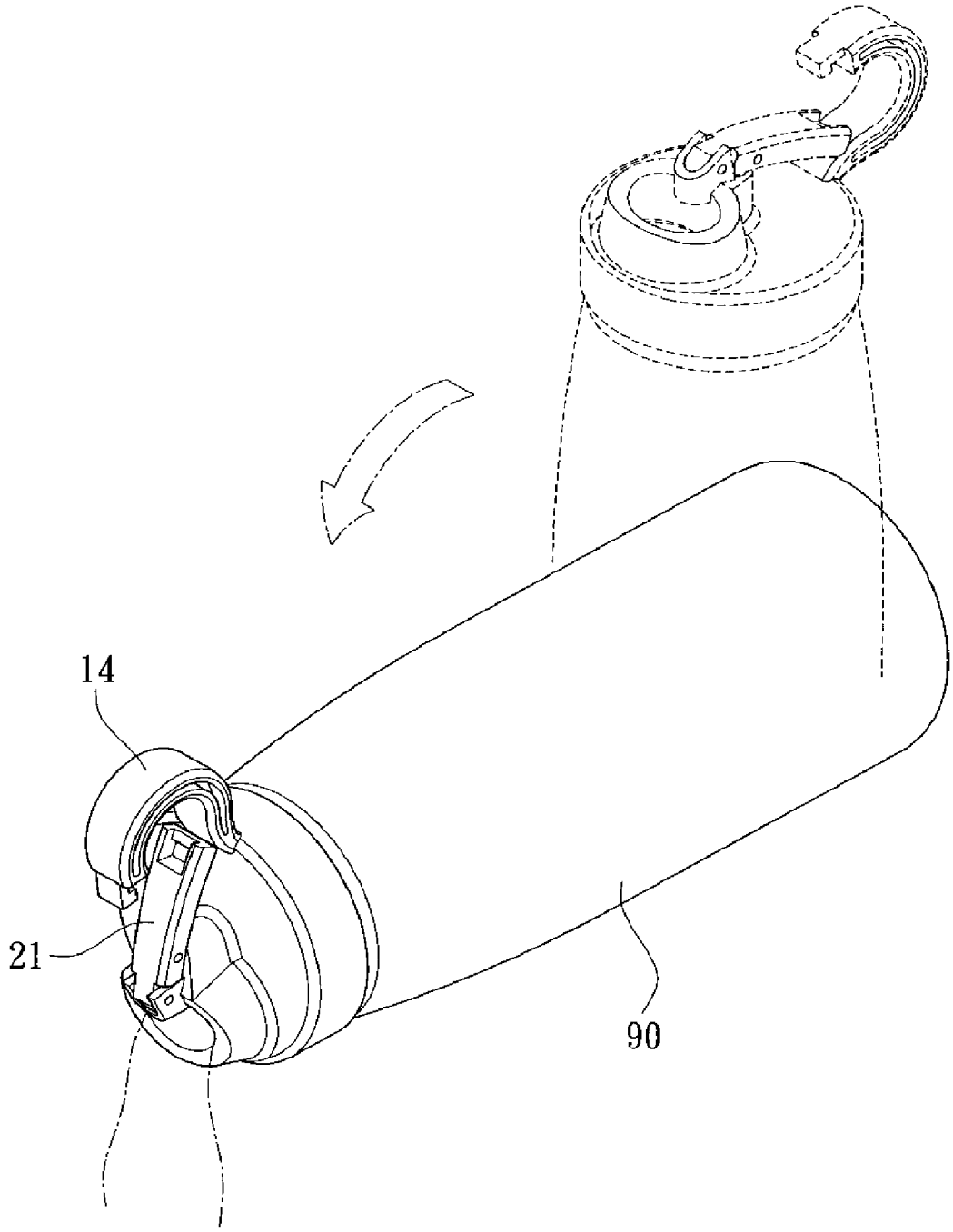
FIG. 9 is a schematic perspective view illustrating an operation of the present invention in pouring water out of a water jar.

Referring to FIGS. 7 and 8, after the depression bar 21 has been depressed through the first stroke, if the depression bar 21 is further depressed to travel through the second stroke, then the second resilient element 33 will be compressed and potential energy is built up to provide a returning spring force, and also, the link 22 and the carrier 23 are caused to depress down the rod 31 to lower the rod 31. Under this condition, the water stop member 40, due to the right side limb thereof (as viewed in FIG. 8) being fixed, exhibits resiliency, which allows the water sealing section 43 on the left side limb of the water stop member 40 to separate from the water passage 121, so that water can be poured out of the water jar 90 for consuming by a user (see FIG. 9). When the depression bar 21 is no longer held down and is released, due to the removal of the depression force, the depression bar 21 is returned back to the original position by the spring forces of the first and second resilient elements 32, 33.

To conclude, the present invention provides an arrangement of a depression bar device, a resiliency device, and a water stop member to effect a two stage operation of discharge and stop of water, whereby the water jar 90 can be readily hanged or picked up for use for easy drinking of the liquid contained therein.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A water stop structure of a water jar lid comprising:

a main body which is adapted to mount to a water jar and having a water outlet port, a chamber and a hanger, said water outlet port having a water passage and a U-shaped flange, inside of said chamber having a step;

a depression bar device having a depression bar, said depression bar having a first end pivotally connected with said U-shaped flange of said water outlet port, said depression bar having a second end engaged with said hanger when said depression bar is in a resting state, said depression bar having a portion close to said first end and pivotally connected with a link, said link being pivotally connected with a carrier which is movably received in said chamber of said main body;

a resiliency device which comprises a rod, a first resilient element, a second resilient element, a ring spacer and a seal, said rod being movably received in said chamber of said main body, said rod having a first portion received in said chamber and a second portion projecting under said main body, said rod having a center bore to receive and retain said first resilient element therein in such a way that a top end of said first resilient element projects outside to couple to said carrier, said rod having a radial flange at a top end thereof and a rounded jointing end at a bottom end thereof, said flange being set in contact with an inside wall of said chamber to maintain a gap between said rod and an inside wall of said chamber for receiving said second resilient element that is arranged inside said chamber but fit outside said rod, said step of said chamber supporting said spacer and said seal in such a way that upper and lower ends of said resilient element are respectively supported on said radial flange of said rod and said spacer; and a water stop member which is coupled to said rod of said resiliency device, said water stop member having one side portion fixed to an underside of said main body and comprising a water sealing section blocking said water passage of said main body, said water stop member having a fitting hole coupled to said jointing end of said rod.

2. The water stop structure for a water jar lid as claimed in claim 1, wherein said hanger of said main body having a free end forming a hook and wherein said depression bar has an end forming a fitting slot engageable with said hook whereby said depression bar and said hanger form a close-loop configuration together.

3. The water stop structure according to claim 1, wherein said main body has an underside surface forming a plurality of coupling pegs and wherein said water stop member forms a plurality of coupling holes, said water stop member being attached to said underside of said main body through said coupling pegs engaging said coupling holes.

4. The water stop structure according to claim 1, wherein said water stop member comprises a silicone rubber pad set at one side portion thereof for sealing said water passage of said main body.

5. The water stop structure according to claim 1, wherein said second resilient element has a spring force greater than a spring force of said first resilient element.

* * * * *